US007854153B2

(12) United States Patent
Lennhoff et al.

(10) Patent No.: US 7,854,153 B2
(45) Date of Patent: Dec. 21, 2010

(54) LOCKING CYLINDER FOR FUNCTIONS ESPECIALLY PERFORMED ON VEHICLES

(75) Inventors: Ralf Lennhoff, Hagen (DE); Mensur Velicanin, Velbert (DE); Lars Gabriel, Velbert (DE); Stefan Mönig, Schwelm (DE); Mario Christensen, Mühlheim an der Ruhr (DE)

(73) Assignee: Huf Hulsbeck & Furst GmbH & Co. KG, Velbert (DE)

( * ) Notice: Subject to any disclaimer, the term of this patent is extended or adjusted under 35 U.S.C. 154(b) by 295 days.

(21) Appl. No.: 11/991,615

(22) PCT Filed: Sep. 7, 2006

(86) PCT No.: PCT/EP2006/008708

§ 371 (c)(1),
(2), (4) Date: Mar. 7, 2008

(87) PCT Pub. No.: WO2007/028604

PCT Pub. Date: Mar. 15, 2007

(65) Prior Publication Data

US 2009/0223264 A1 Sep. 10, 2009

(30) Foreign Application Priority Data

Sep. 7, 2005 (DE) ..... 10 2005 042 350

(51) Int. Cl.
*E05B 9/08* (2006.01)

(52) U.S. Cl. ..... 70/370; 70/237; 70/379 R; 70/451; 70/492

(58) Field of Classification Search ..... 70/237, 70/451, 367–371, 466, 379 R, 379 A, 380, 70/492, 372–374, 391, 447–449, 452
See application file for complete search history.

(56) References Cited

U.S. PATENT DOCUMENTS

| | | | | | |
|---|---|---|---|---|---|
| RE18,498 | E | * | 6/1932 | Norviel | 361/269 |
| 2,724,958 | A | * | 11/1955 | Psik | 70/181 |
| 3,358,483 | A | * | 12/1967 | Wellekens | 70/370 |
| 3,589,152 | A | * | 6/1971 | Glass et al. | 70/81 |
| 5,224,364 | A | * | 7/1993 | Claar et al. | 70/237 |
| 5,775,147 | A | * | 7/1998 | Wittwer | 70/379 R |
| 6,494,066 | B2 | * | 12/2002 | Muneta | 70/208 |
| 7,213,428 | B2 | * | 5/2007 | Harada et al. | 70/256 |
| 2008/0185850 | A1 | * | 8/2008 | Takaya et al. | 292/336.3 |

FOREIGN PATENT DOCUMENTS

| | | |
|---|---|---|
| DE | 200 16 108 | 1/2001 |
| DE | 203 12 399 | 11/2003 |
| DE | 103 40 272 | 3/2005 |
| DE | 103 46 956 | 4/2005 |
| EP | 0 221 375 | 5/1987 |
| GB | 2 245 643 | 1/1992 |
| WO | 00/43619 | 7/2000 |

* cited by examiner

*Primary Examiner*—Lloyd A Gall
(74) *Attorney, Agent, or Firm*—Lucas & Mercanti, LLP; Klaus P. Stoffel

(57) ABSTRACT

A locking cylinder having a two-part housing, including an upper part and a lower part. A cylinder core is received in the housing and can be actuated by turning a key. The housing of the locking cylinder is fastened to the body of a vehicle by a fastener. The fastener used to fasten the housing of the locking cylinder on the body is also used as a connector for fastening the housing upper part on the housing lower part.

7 Claims, 7 Drawing Sheets

LOCKING CYLINDER FOR FUNCTIONS ESPECIALLY PERFORMED ON VEHICLES

BACKGROUND OF THE INVENTION

The invention concerns a locking cylinder that consists of a cylinder core, which is rotatably supported in a two-part bearing housing and initiates certain functions in the vehicle when a key is turned.

Vehicle doors or hatches are an important area of application of locking cylinders of this type. The functions arising in this case are the securing and releasing of the doors and hatches. This is intended to bar access to the vehicle by unauthorized persons. Authorized persons have a key that is assigned to the locking cylinder and is inserted in a key slot of the cylinder core and thereby moves the spring-loaded tumblers into the cylinder core. The cylinder core can then be moved by means of the key from a home position to various operating positions. The upper and lower parts of the bearing housing serve the purpose of rotatably supporting the cylinder core and hold other possible components of the housing. At one end of the joined housing parts, the key slot is accessible to the key, while a driver is rotatably supported at the other end. The driver transmits a rotation of the cylinder core via a connecting rod to the functional parts in the vehicle located behind the locking cylinder.

In the previously known locking cylinder, the two parts of the housing, together with the components they hold, must be held together by pins. When the two parts of the housing have to be separated from each other, e.g., to replace a defective component, the removal of the spiral pin is a laborious operation. In addition, points of application for the fastening means must be provided on the housing, by which the housing can be mounted on the body of the vehicle. This is time-consuming and takes up too much space.

EP 0 221 375 A1 concerns the "sandwich mounting" of a locking cylinder, the details of which are not shown, in a hole of a body wall. Two mounting parts, which engage each other from opposite sides of the body wall and are joined by a bayonet coupling, serve as mounting means for the installation of this locking cylinder. The two mounting parts have no bearings for rotatably supporting the cylinder core of the locking cylinder, the details of which are not shown.

DE 203 12 399 U1 also discloses a sandwich mounting of a locking cylinder in a hole of a pane of glass by means of two mounting parts, which are supported with flanges on the two opposite sides of the pane of glass. The two mounting parts are tightened relative to each other by three bolts and thus hold the locking cylinder between them. The bolts have no effect with respect to holding the components of the locking cylinder together; the locking cylinder is already completely assembled when installed and has no need of further means to hold it together.

Finally, GB 2 245 643 A also describes a sandwich mounting of a fully assembled locking cylinder in a central hole of a door. To this end, two mounting parts that fit against the two outside surfaces of the door are tightened relative to each other by two screws. The screws do not interact with the components of the locking cylinder. First, the two mounting parts are attached to the door, and only then is the assembled locking cylinder inserted. One-piece, elastically deformable retention fingers are used to mount the locking cylinder in one of the two mounting parts. These retention fingers have hook-like ends that snap into an annular, circumferentially continuous groove.

In DE 200 16 108 U1, a complete locking cylinder is inserted in the drill hole of a base plate, which is mounted on the rear side of a vehicle door. A pull handle is then twisted in, so that it is rotatably supported from the outside of the door in the base plate on the rear side. Then, on the front side, a cover is placed over the protruding section of the locking cylinder, which secures the pull handle in its mounted position. A fastening screw passes through a drill hole in the cover and a drill hole in the base plate and is screwed into a threaded hole in the housing of the locking cylinder. The mounted locking cylinder is thus nonrotatably fixed in the drill hole of the base plate. The fastening screw has no effect with respect to holding together the components of the locking cylinder.

WO 00/43619 A1 shows, first of all, an external housing that is permanently mounted in a receptacle of a door. The external housing holds an internal housing, which has a cross-sectional profile in the form of a figure eight and consists of an upper housing cavity and a lower housing cavity. The lower housing cavity has a cylindrical bore for the rotatable support of the actual cylinder core, while the upper housing cavity always accommodates a number of sections of pin tumblers, of which a last section is positioned in the cylinder core when the key is inserted. To mount the internal housing in the external housing, the key must be inserted and brought into a well-defined inclined position to expose a slot in the internal housing. Only then, during the mounting operation, can an inner projection in the receptacle of the external housing be moved into the slot in the internal housing. The means for fastening the internal and external housing have nothing to do with holding the cylinder core and the internal housing together, but rather a separate locking ring is used for this purpose, which snaps into a groove in the cylinder core that projects from the internal housing.

SUMMARY OF THE INVENTION

The objective of the invention is to develop a locking cylinder which avoids the disadvantages mentioned above. This objective is achieved by the measures of the present invention, which have the following special significance.

Although the locking cylinder is a preassembled unit, which can be handled as a self-contained unit when it is being mounted on the vehicle body, its components are not yet fastened to each other. Before it is mounted, the unit can simply be separated into the components of the cylinder. In the unit, the projecting tab of the upper part of the housing and a corresponding mating part of the lower part of the bearing housing lie directly against each other, and the holes for fastening them together are aligned. As a result, the same bolt fastening means can be used both for bolting together all of the components of the unit and for bolting the unit to the body.

In the invention, the bolt fastening means for mounting the housing on the body has a dual function. The first, customary, function consists in using the same bolt fastening means for simultaneously joining the upper part and the lower part and thus for rotatably supporting the cylinder core contained therein. Accordingly, a single means and a single handling of this bolt fastening means are sufficient for carrying out several functions in the locking cylinder at the same time. Space and assembly time are saved in this way. At the same time, the possible separation of the two parts of the housing is very simple, because as soon as the bolt fastening means is removed from the body, the components of the unit are also no longer attached to each other and can be immediately separated from each other. This allows replacement and repair of the components of the locking cylinder to be carried out as fast as possible. Access is obtained to the components enclosed inside the housing.

Further measures and advantages of the invention are revealed in the description below, and the accompanying drawings, which illustrate a specific embodiment of the invention.

DETAILED DESCRIPTION OF THE INVENTION

Figure 1:
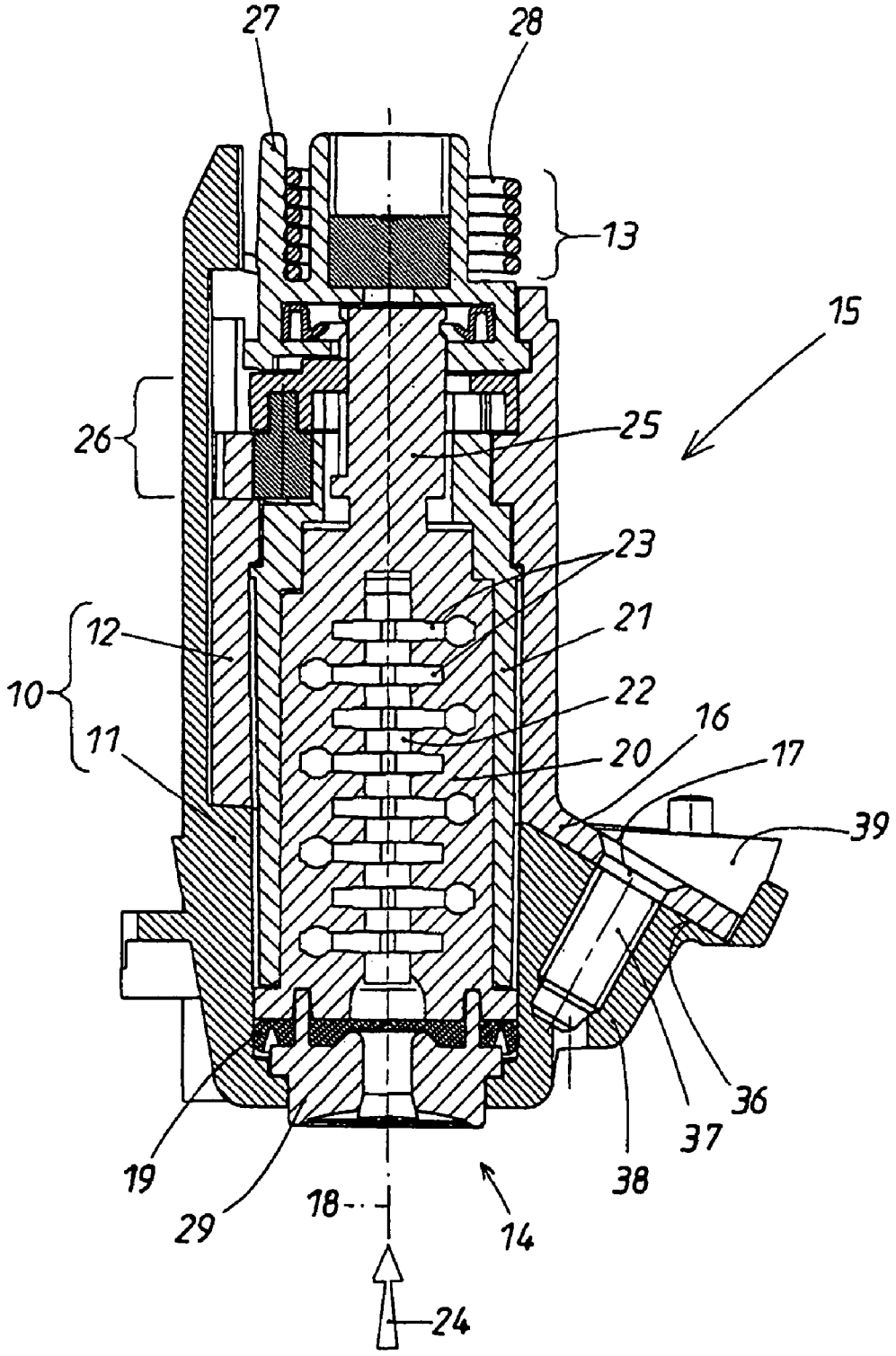
FIG. 1 shows an axial section through an assembled locking cylinder before it is mounted on the body of the vehicle.
Figure 2:
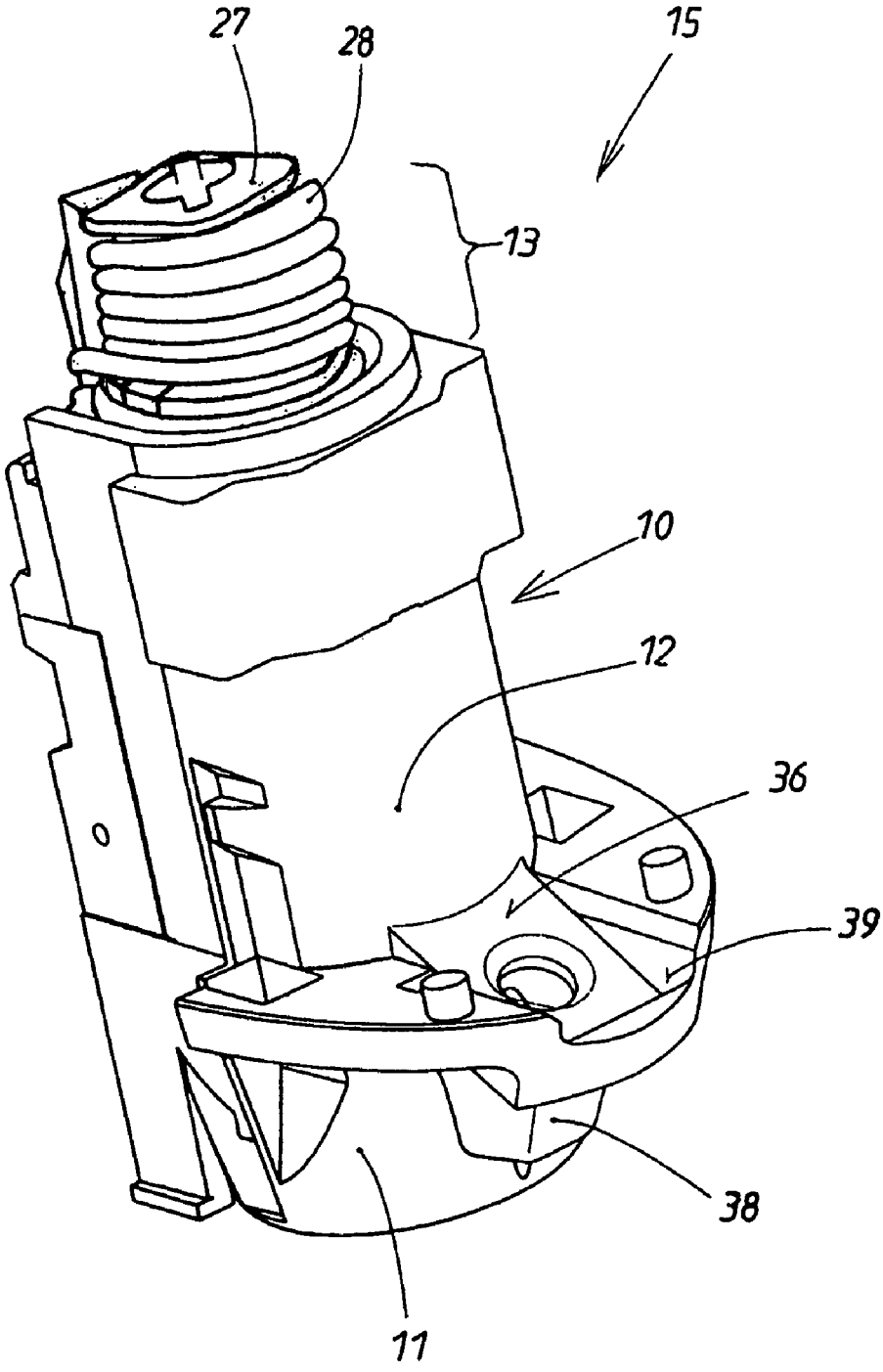
FIG. 2 shows a perspective view of the locking cylinder shown in FIG. 1.

As is best seen in FIG. 1, the housing 10 of the locking cylinder consists of two housing parts 11, 12, whose appearance is revealed by the perspective views in FIGS. 3*a* to 4*b*. To make it easier to distinguish the two parts of the housing, the housing part 11 that faces the user will be referred to as the "lower part", and the housing part 12 will be referred to as the "upper part". The two parts 11, 12 of the housing 10 enclose a large number of components, which in the assembled state constitute a preassembled unit 15, as shown in FIG. 1.

These components within the housing 10 include above all a cylinder core 20, which is rotatably supported inside a free-running sleeve 21. The free-running sleeve 21 is normally at rest in the housing 10. The cylinder core 20 has an axial key slot 22, which is traversed by several chambers 23. The chambers 23 serve to hold spring-loaded tumblers, whose ends, which are not seen in the drawing, fit into at least one axial groove of the free-running sleeve 21. The cylinder core 20 is then rotationally secured.

To release the cylinder core 20 for rotation, an associated key (not shown) must be inserted in the key slot 22 in the direction indicated by the arrow 24. The key then moves the tumblers flush with the cross section of the cylinder core 20. The ends of the tumblers then no longer engage the groove of the free-running sleeve 21, and the cylinder core 20 can be turned by the inserted key.

When the key is turned, the torque is transmitted from a terminal output end 25 of the cylinder core 20, via a free-running device 26 that comprises several components, to a driver 27, which is located at the inner outlet 13 of the housing 10. A pulse spring 28, which works to hold the driver 27 in a well-defined home position, normally also acts on the cylinder core 20. In the normal case, when the free-running sleeve 21 is at rest, the cylinder core 20 is also kept in this home position via the free-running device 26.

An armored faceplate 29 is mounted in front of the outer outlet 14 of the housing 10 and is nonrotatably joined with the cylinder core 20 by means of pins and recesses. An elastomer disk 19 is installed between the faceplate 29 and the cylinder core 20. The faceplate 29 defines the insertion hole for the key and is shaped to conform to the cross section of the key. The elastomer disk 19 has a sealing function and at the same times serves as a shock absorber for forceful blows made in the direction of insertion arrow 24 in an attempt to break into the vehicle.

Figure 4A:
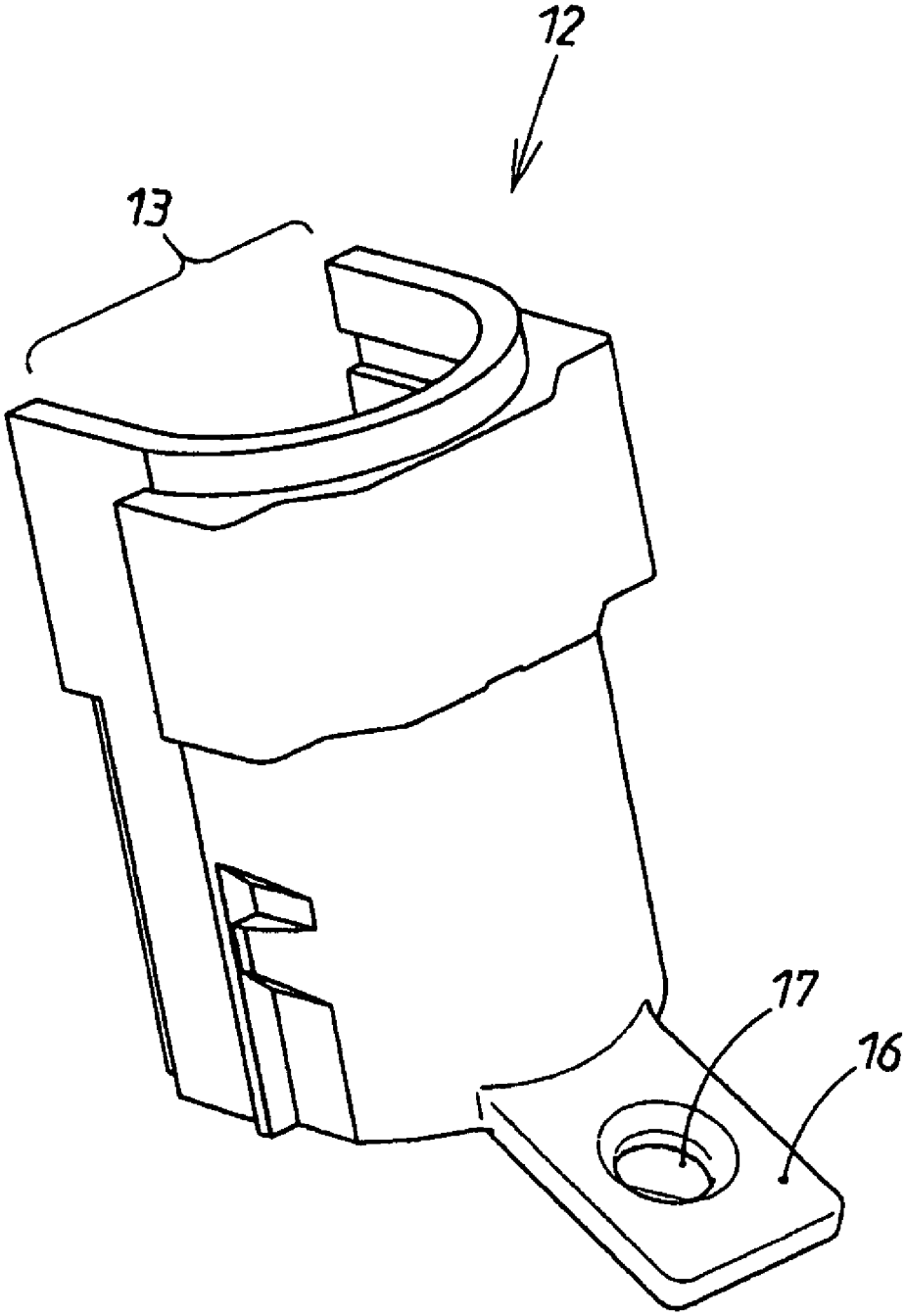
Figure 4B:
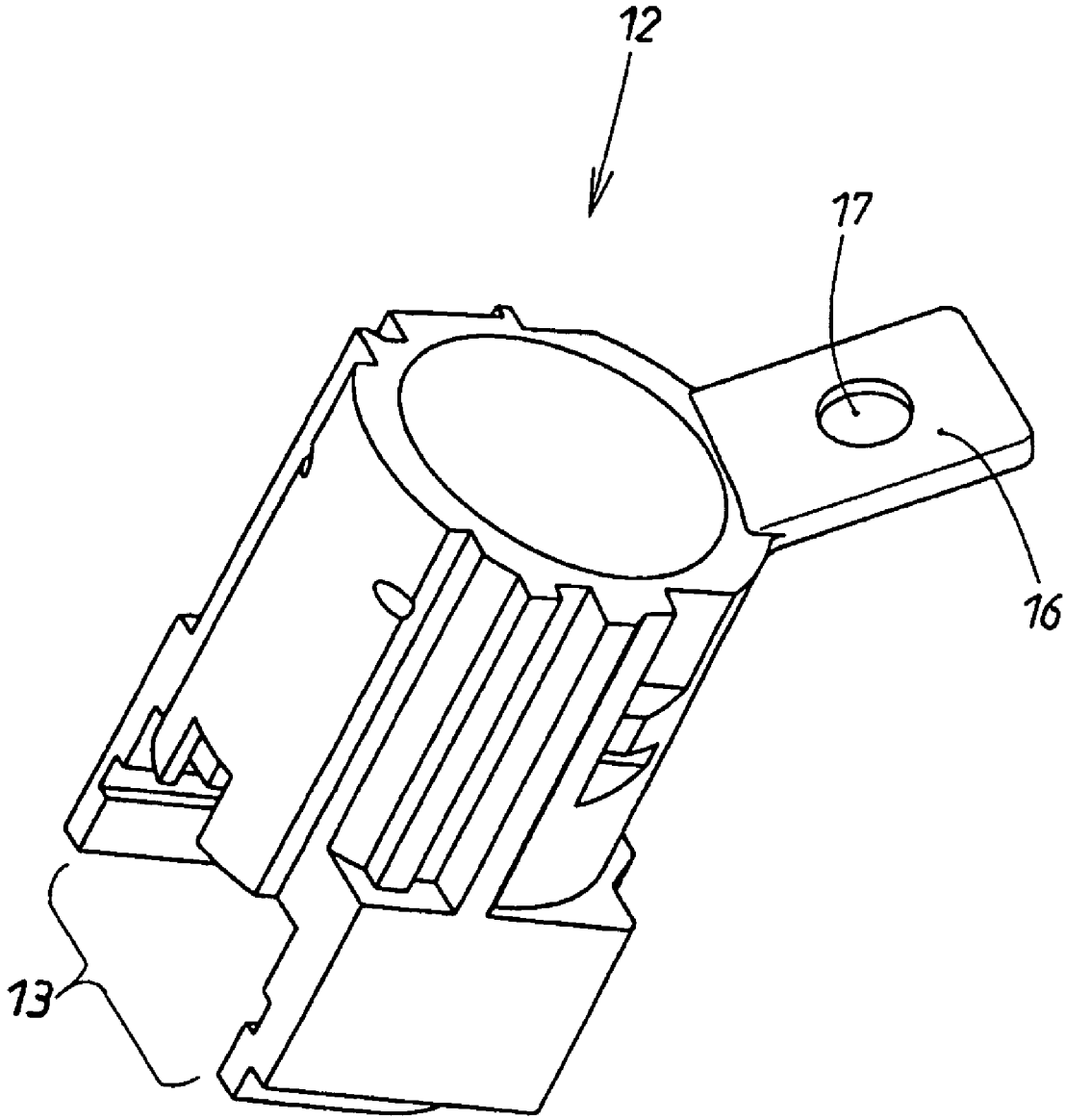

As is best seen from the detail views of FIGS. 4*a* and 4*b*, the upper housing part 12, which is partly shaped like a sleeve, is provided with a tab 16 with a hole 17. As FIG. 1 shows, in the assembled state, the tab 16 extends obliquely to the axis 18 of the locking cylinder and thus the cylinder core 20. The axis 18 is indicated by a dot-dash line in FIG. 1.

Figure 3A:
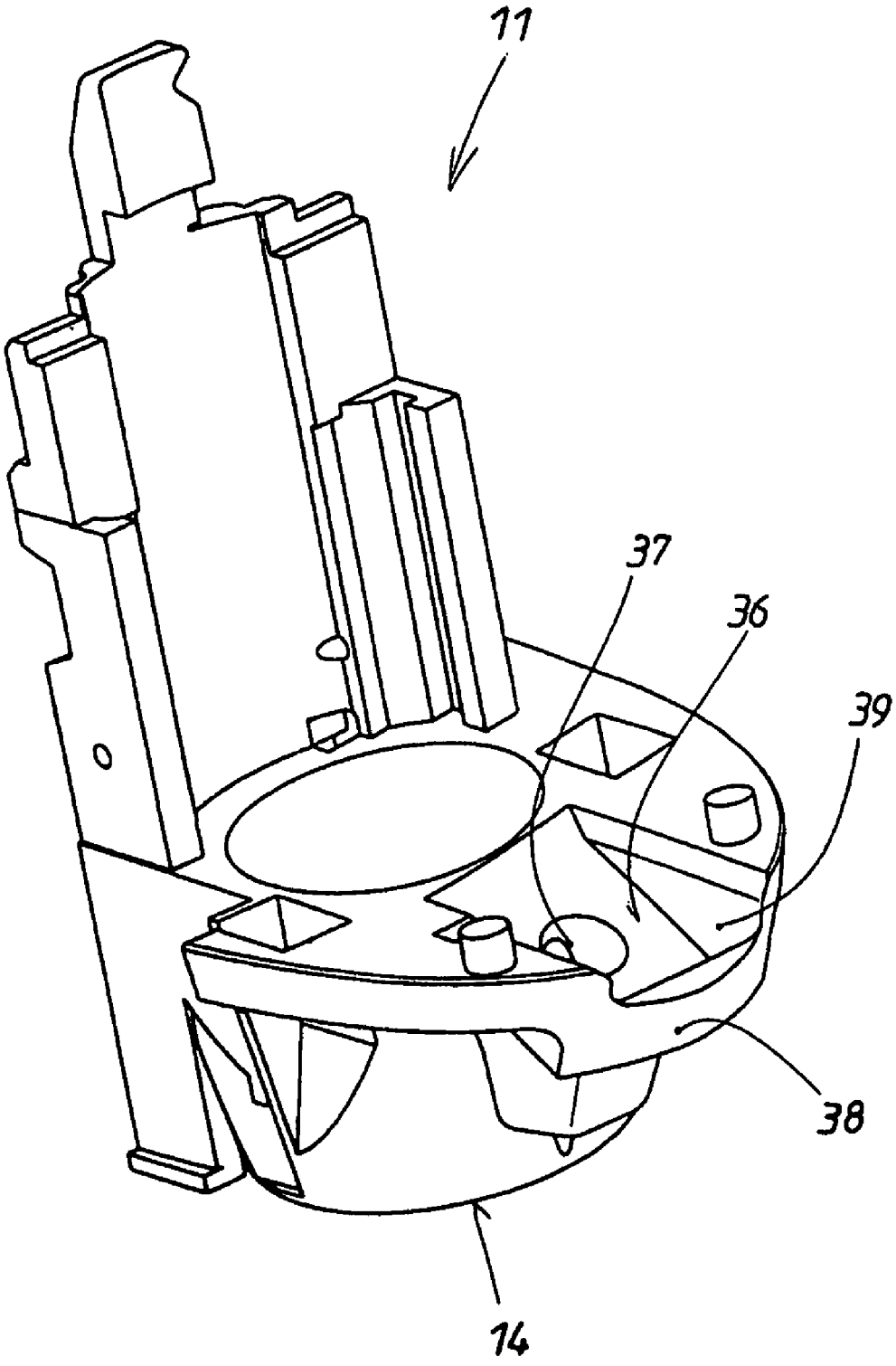
FIGS. 3*a* and 4*a*, on the one hand, and FIGS. 3*b* and 4*b*, on the other hand, show two oppositely directed perspective views of the upper part of the housing and the lower part of the housing of the locking cylinder of FIG. 1 before they are joined to each other and before the other components are installed inside the housing.
Figure 3B:
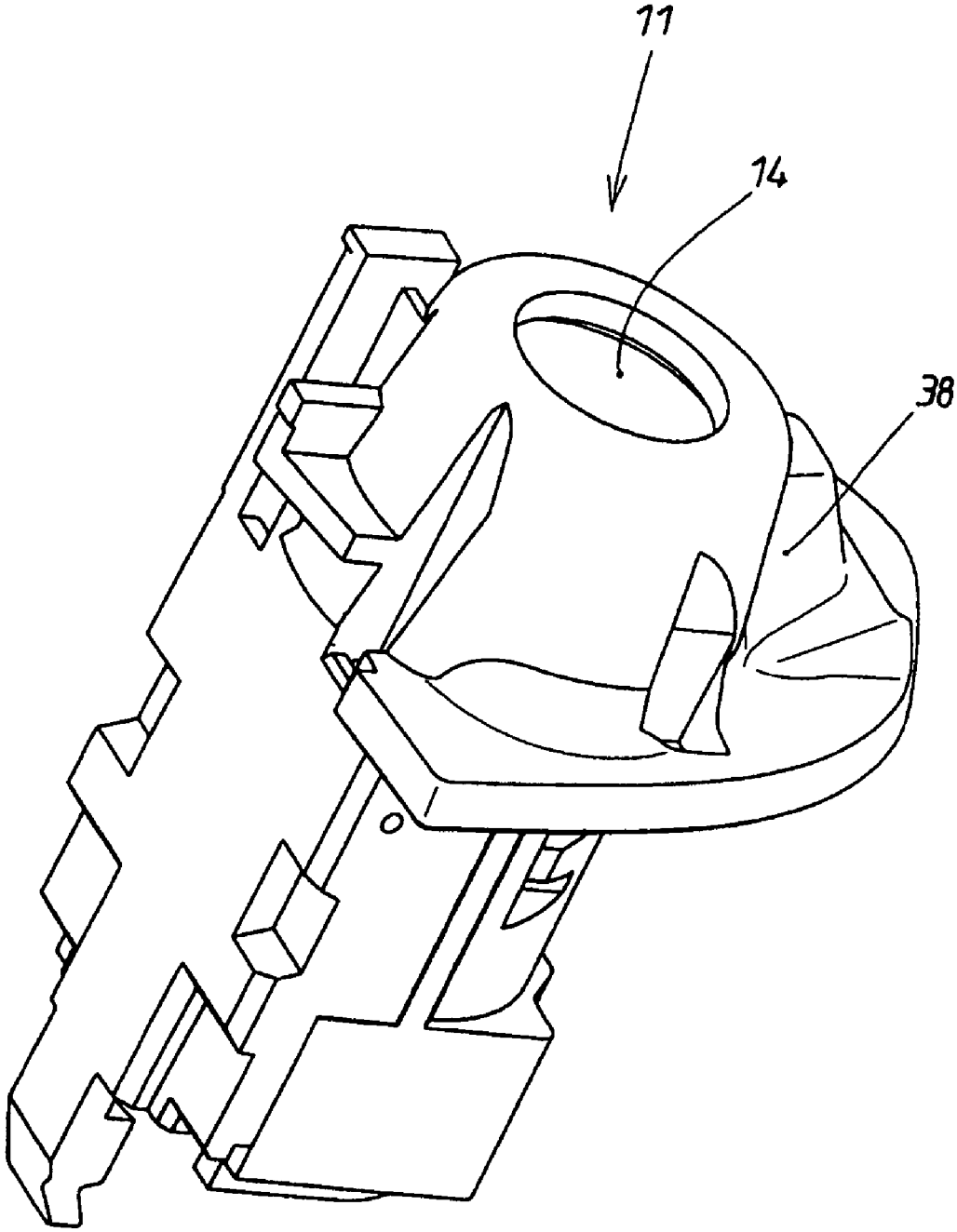

FIGS. 3*a* and 3*b* show the appearance of the lower part 11 of the housing. As is also apparent from the axial section in FIG. 1, the lower part 11 has a lateral housing extension 38 with a recess 39, whose base region forms a mating part 36 for the tab 16. The housing extension 38 is provided with a threaded receptacle 37.

When the unit 15 of FIG. 1 is being assembled, the two housing parts 11, 12 can be temporarily held together by locking means and their mating devices, which are not shown in the drawing. However, this type of locking is obtained above all when, as FIG. 1 illustrates, the tab of the housing upper part 12 fits into the recess 39 of the housing extension 38 of the housing lower part 11. The final connection between the two housing parts 11, 12 is realized in the present case by fastening means 30, which mount the locking cylinder on the body 33 of the vehicle. This will be explained in greater detail in connection with FIG. 5.

Figure 5:
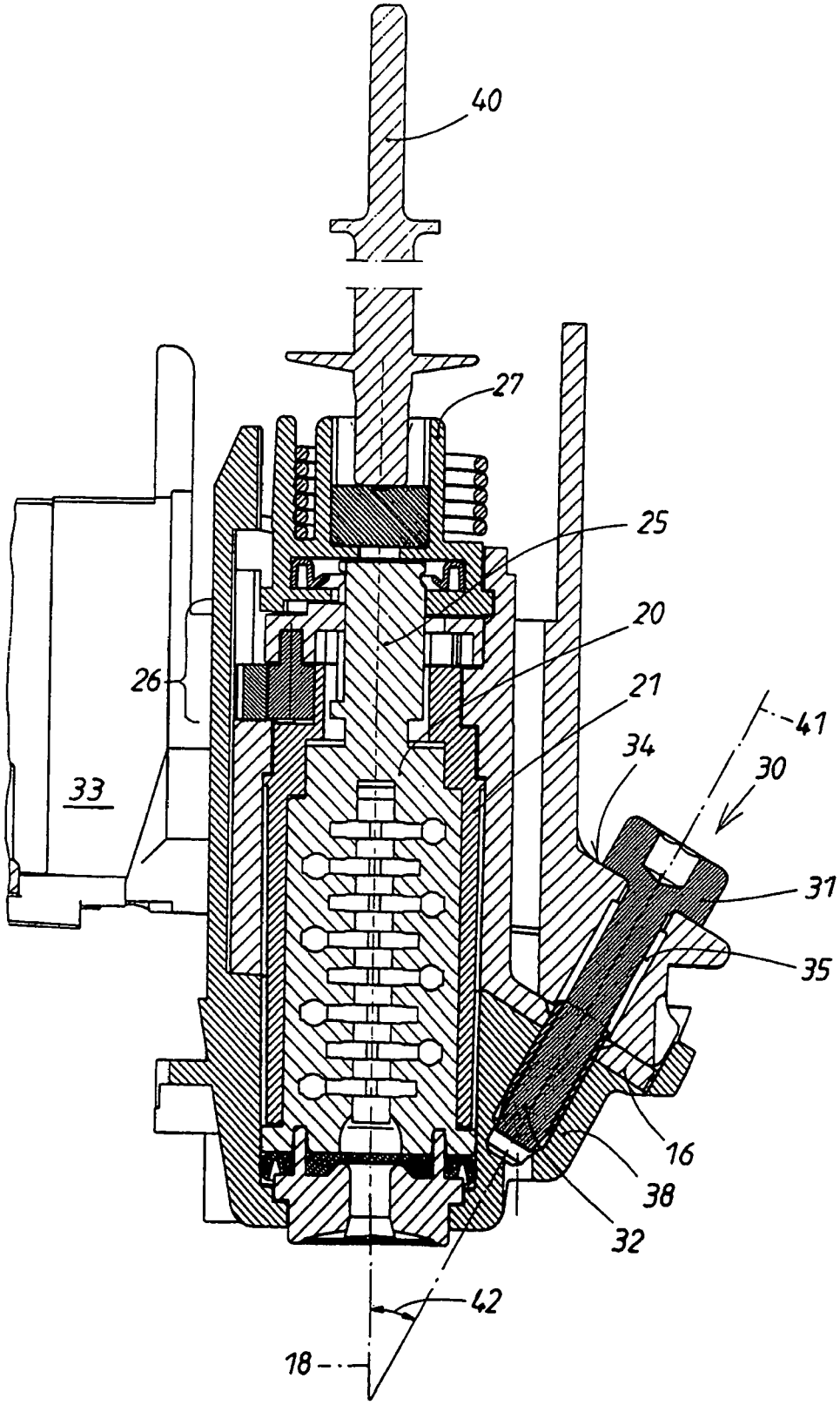
FIG. 5 shows an axial section, analogous to FIG. 1, through the locking cylinder mounted on the body of the vehicle.

FIG. 5 shows a portion of a body 33 of a vehicle, such as a vehicle hatch, which is to be equipped with the locking cylinder. The fastening means consists of a bolt 30. The body 33 has a well-defined mounting location 34 for the locking cylinder. A hole 35 for the bolt 30 is provided there. In the fastened state, the shaft of the bolt 30 passes through the hole 35 and the tab 16 in the housing upper part 12, while the threading 32 of the bolt engages the aforementioned threaded receptacle 37 of the housing extension 38. The head 31 of the bolt 30 rests against the upper side of the body mounting location 34. In the fastened state shown in FIG. 5, the axis 41 of the bolt 30, which is indicated by a dot-dash line, extends at an acute angle 42 to the axis 18 of the cylinder core 20.

In the fastened state shown in FIG. 5, the driver 27 of the locking cylinder is connected by a rotary joint 40 with those units in the vehicle which are to carry out the desired functions in the vehicle when the locking cylinder is actuated by being turned. In the present case, the rotary joint 40 is intended to connect the driver with a lock in the hatch of the vehicle. This lock can be switched between a secured position and a released position. It goes without saying that the driver could also be used to actuate any other desired functions in the vehicle.

In the event of a forceful rotation of the cylinder core with burglary tools by unauthorized persons, the cylinder core 20 remains engaged with the free-running sleeve 21 by the aforementioned outwardly projecting ends of the tumblers. A catch between the free-running sleeve 21 and the housing 10 is then released, and the cylinder core 20 rotates inside the housing along with the free-running sleeve 21. During forced rotation, the free-running device 26 decouples the driver 27 relative to the terminal output end 25 of the cylinder core 20. Therefore, despite the forceful rotations by means of the burglary tool, the driver 27 and thus the rotary joint 40 connected with it remain at rest, and so no function is carried out in the vehicle.

LIST OF REFERENCE NUMBERS

10 housing
11 lower part of 10
12 upper part of 10
13 inner outlet of 10
14 outer outlet of 10
15 unit

16 tab on 12
17 hole in 16
18 axis of the locking cylinder
19 elastomer disk
20 cylinder core
21 free-running sleeve
22 key slot
23 chamber
24 arrow indicating the direction of insertion of the key
25 terminal output end
26 free-running device
27 driver
28 pulse spring
29 faceplate
30 fastening means, bolt
31 head of 30
32 threading of 30
33 body of the vehicle
34 mounting location on 33
35 hole in 34
36 mating part for tab 16 on 38
37 threaded receptacle in 38
38 housing extension on housing part 11
39 recess in 38 for 36
40 rotary joint at 27
41 axis of 30
42 acute angle between 41, 18

The invention claimed is:

1. A locking cylinder for a vehicle, with a cylinder core (20), which has an axial key slot (22) for inserting an associated key and radially moving, spring-loaded tumblers that interact with the key, with a two-part housing (10) that comprises an upper part (12) and a lower part (11) and serves to rotatably support the cylinder core (20), the upper part (12) has a projecting tab (16) with a first hole (17), and the lower part (11) has a part (36) that mates with the tab (16) and that has a second hole (37), the upper part (12), the cylinder core (20) and the lower part (11) constitute a preassembled unit (15), in which the tab (16) rests directly against its mating part (36) (16), and the two holes (17, 37) are aligned, with a single bolt fastening means (30), which is passable, on the one hand, through a hole (35) in a body (33) of the vehicle and, on the other hand, passes through the two holes (17, 37) of the unit (15), only the single bolt fastening means (30) not only bolts together all of the upper part (12), the cylinder core (20) and the lower part (11) of the unit (15) but also is capable of bolting the unit (15) to the body (33).

2. A locking cylinder in accordance with claim 1, wherein locking means and mating devices are provided between the upper part (12) and the lower part (11) of the housing (10) and serve to temporarily hold together the two housing parts (11, 12).

3. A locking cylinder in accordance with claim 1, wherein that the hole in the mating part (36) of the lower part (11) of the housing (10) consists of a threaded receptacle (37), into which a threaded end (32) of the bolt fastening means (30) is screwed in the mounted state.

4. A locking cylinder in accordance with claim 3, wherein the mating part (36) is formed from a lateral housing extension (38) of the housing lower part (11).

5. A locking cylinder in accordance with claim 1, wherein the axis (41) of the bolt fastening means (30) forms an acute angle (42) with the axis (18) of the locking cylinder.

6. A locking cylinder in accordance with claim 1, wherein a mounting location (34) on the body (33), which has the hole (35) in the body, as well as the tab (16) and the mating part (36) of the two housing parts (12, 11) extend at an inclination to the axis (18) of the cylinder core (20).

7. A locking cylinder in accordance with claim 1, wherein the locking cylinder is rotatably supported in a free-running sleeve (21), which is normally at rest; that a free-running device (26) is installed between a terminal output end of the cylinder core (20) and a driver (27) at an outlet of the housing; and that, under normal conditions, when the cylinder core (20) is turned by the key, the free-running device (26) transmits the torque of the locking cylinder to the driver (27), but that, under overload conditions, the free-running device (26) decouples the driver (27) from the cylinder core (20) when a burglary tool causes the cylinder core (20) to undergo forceful rotation that exceeds a well-defined limit torque of the free-running device (26).

* * * * *